United States Patent [19]

Crawshaw

[11] Patent Number: 4,988,237

[45] Date of Patent: Jan. 29, 1991

[54] SOIL GAS REDUCTION SYSTEM

[76] Inventor: Geoffrey K. Crawshaw, 42 Lehigh Rd., Wellesley, Mass. 02181

[21] Appl. No.: 414,907

[22] Filed: Sep. 29, 1989

[51] Int. Cl.[5] ..... E02D 27/00

[52] U.S. Cl. ..... 405/229; 52/169.1; 52/169.5; 98/33.1; 405/303

[58] Field of Search ..... 405/229, 258, 131, 303; 52/169.1, 169.5; 98/33.1

[56] References Cited

U.S. PATENT DOCUMENTS

| | | | |
|---|---|---|---|
| 2,746,372 | 5/1956 | Smith et al. | 98/33.1 X |
| 3,093,056 | 6/1963 | Rosenfeld | 98/33.1 X |
| 4,175,934 | 11/1979 | Lang et al. | 98/33.1 X |
| 4,506,655 | 3/1985 | Kuechler | 98/33.1 X |
| 4,578,912 | 4/1986 | Ericsson . | |
| 4,620,398 | 11/1986 | Wallin . | |
| 4,651,380 | 3/1987 | Ogden . | |
| 4,773,309 | 9/1988 | Walters . | |
| 4,789,388 | 12/1988 | Nishibata . | |
| 4,798,034 | 1/1989 | Jarnagin . | |
| 4,801,800 | 1/1989 | Scheible . | |
| 4,829,882 | 5/1989 | Jackson . | |

OTHER PUBLICATIONS

EPA/625/5-86-019, "Radon Reduction Techniques for Detached Houses", 32-41 (1986).

*Primary Examiner*—Dennis L. Taylor

*Attorney, Agent, or Firm*—Hamilton, Brook, Smith & Reynolds

[57] ABSTRACT

A system for extracting radon and other gases from a subterranean cavity beneath a floor slab and venting of collected gases to the atmosphere is provided which conducts cool, naturally occuring radon and other gases under high vacuum across a vacuum pump motor for cooling the motor. A vacuum pump is disposed within a housing chamber under vacuum. Cool gases within the housing chamber thereby conduct heat generated by the pump motor to the atmosphere.

17 Claims, 1 Drawing Sheet

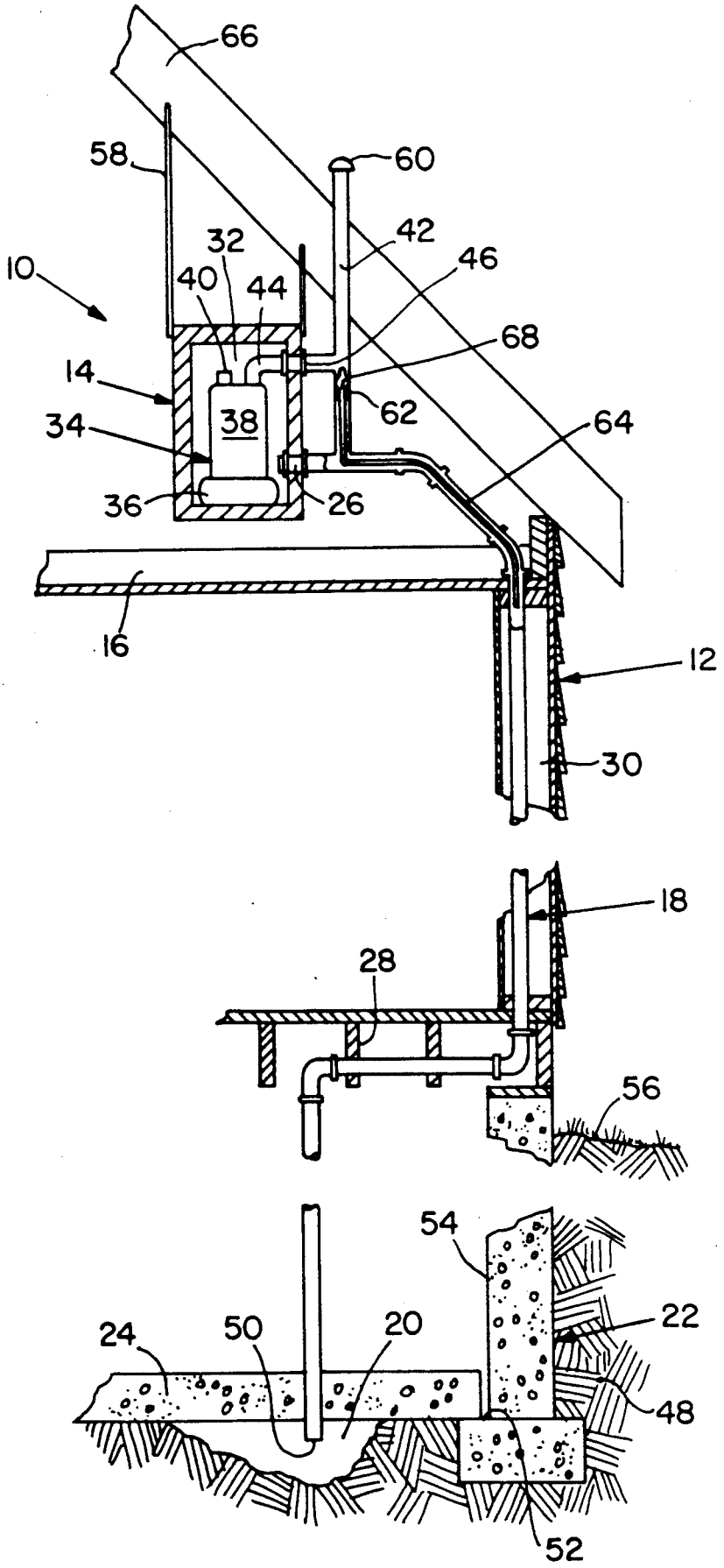
66
58
60
42
32
46
10
40
44
68
14
62
38
64
34
36
26
16
12
30
18
28
56
54
22
24
50
20
48
52

SOIL GAS REDUCTION SYSTEM

BACKGROUND OF THE INVENTION

Radon is a link in the chain of decay of uranium-238 and occurs naturally in soil as a radionuclide gas that dissipates by exposure of soil to the atmosphere. Background readings of radioactivity of radon are reported to average about 0.25 pCi per liter by the Environmental Protection Agency. (See, Radon Reduction Techniques for Detached Houses, Technical Guidance, EPA/625/5-86/019, pg. 2). In contrast, undiluted soil gas reported by the same publication ranges from "a few hundred to several thousand pCi per liter" (Ibid). Lung cancer has been associated with the presence of radon gas: the risk of occurance ranges up to 75 times the normal risk of lung cancer (pg. 3).

Radon gas permeates construction materials such as porous cement blocks or poured foundations which have become porous over time or which have cracked due to stress. Radon can, therefore, penetrate building structures at high concentrations and consequently collect in enclosed areas. Although radon has a half-life of approximately 3.8 days and ultimately will either be ventilated outside the structure or decay, elevated concentrations of radon will persist indefinitely by continuous decay of uranium in soil and permeability of the soil to radon gas. A continuing high risk of lung cancer thus exists to occupants exposed over long periods of time.

Common methods used to-date to control the presence of radon have included use of filters, sealing points of entry within the structure, and better ventilation to increase the rate at which the volume of air contained within the structure is replaced. Filters have not been proven to be effective for removal of decay products such as radon because as a gas, the predominant portion of the gas remains unattached to particulates which can be collected by air cleaners. Entry of radon can also be reduced by application of sealing materials at points of entry in foundation structures. Points of entry typically include wall and floor joints, settling cracks, utility penetrations such as cable connections, and the porous nature of concrete. However, application of such methods are of only limited use and are not usually sufficient to remove radon which is penetrating structures except in a few specific applications. Further, sealants deteriorate and cracks and fissures tend usually to propagate, thereby minimizing the effectiveness of seals.

Ventilation has proven to be the most reliable and universally applicable means for continuously removing radon gas from subterranean foundation structures. Air captured within buildings is replaced according to patterns of usage of the building by the occupants and by the type of building design and materials selected for construction. Ventilation of residential homes historically has been passive. However, improved insulation and installation of climate control systems has reduced the rate of air replacement, thus increasing the need for active ventilation to dissipate radon gas entering living quarters. Several methods have been devised which ventilate radon-containing gas to the atmosphere from points of entry at the foundation.

Typical of radon ventilation techniques are fan-driven methods drawing radon-containing air from soil adjacent the subterranean structure into a conduit for discharge to the atmosphere. While fan-driven displacement of air is substantially more effective than either sealing techniques or filtration of captive air, there are severe limitations in that the low pressure difference generated by ventilation fans requires large volumes of air to conduct radon from within the structure. Extensive modifications must usually be made to adapt existing foundations for collection of radon-containing gas dissipating from surrounding earthen excavations. Examples of modifications which must be made to existing foundation structures in order to draw radon from beneath such structures by use of fans include removal of existing concrete slabs and deposition of aggregate over which a liner is laid, followed by poring a restored concrete floor. Another example is removal of the existing slab followed by laying perforated pipes within an aggregate bed over which a new slab floor is pored. However, removal and replacement of existing slab concrete is expensive, difficult and may detrimentally effect the structural integrity of the foundation and of the building supported above it. Further, piping and aggregate beds eventually may become blocked or filled with surrounding earth caused by water drainage patterns around the foundation. Thus, a more durable and inexpensive system is needed for installation in existing structures.

SUMMARY OF THE INVENTION

A partial solution to ventilation problems encountered by use of fans is to instead use high vacuum pumps. Elaborate duct work is made unnecessary by high vacuum which enables extraction of radon from proximate subterranean cavities through existing drain piping or other limited access points. Another advantage of high vacuum afforded by vacuum pumps is use of conduits of smaller diameter than are required by fans, thus allowing more variability in design and decreased expense of installation.

We have found that despite the above advantages, high vacuum systems suffer from a number of disadvantages. Pumps of adequate capacity typically consume more energy and generate considerably more heat than do ventilation fans. Adequate dissipation of heat from high vacuum pump motors is difficult to achieve in conventional sheltered enclosures which are necessary to protect vacuums pumps for extended periods. Further, pumps are more obtrusive than small lightweight fans and vibration of relatively heavy pump motors is more difficult to shield from occupied portions of buildings. Sufficient insulation of pump motors and removal of vacuum pumps to remote locations, such as an attic, to minimize the effects of noise and vibration tends to overheat the motor and therefore significantly reduce the reliability and useful life of the vacuum pump.

A need exists, therefore, for a vacuum pump system which is inexpensive to install, provides versatility of application, does not obstruct otherwise occupied space or living quarters, and minimizes vibration and noise, while providing sufficient cooling to the pump motor and effective venting of radon gas collected from soil adjacent to building foundations.

This invention solves the above problem by providing a system for extracting radon gas from a subterranean cavity within soil at a floor slab and venting of the radon gas thus collected to the atmosphere. More specifically, a pump for creating high vacuum and a low gas flow is enclosed within a novel housing chamber. A vacuum conduit extends to the housing from a cavity adjacent to a foundation. Cool radon-containing gas is drawn by the vacuum pump from the cavity through the vacuum conduit and to the housing chamber. The cool gas passes over the vacuum pump motor to cool the motor and is then drawn into the vacuum pump head. A vent extends from the pump head to the atmosphere through which radon-containing gas is vented to the atmosphere. The housing chamber is preferably disposed in an attic of a building supported by the foundation. Alternately, it may be disposed elsewhere, such as within the foundation, other parts of the supported building, or outside the building.

The housing chamber seals the vacuum pump inlet from the surrounding atmosphere, enabling creation of vacuum by the pump within the vacuum conduit and the cavity. Enclosure of the vacuum pump and vacuum pump motor within the housing chamber provides for cooling of the pump motor by cool radon-containing gas drawn from the cavity. The vent provides fluid communication between the vacuum pump outlet and the atmosphere, and is sealed from the vacuum conduit and vacuum pump inlet for maintaining vacuum within the housing chamber. The housing chamber also protects the pump from environmental or atmospheric factors and shields noise and vibration of the pump to provide an inexpensive, efficient, reliable and unobtrusive system for continuous removal of radon and other gases from soil contiguous with subterranean structures.

The above, and other embodiments of the invention, will now be described in detail.

BRIEF DESCRIPTION OF THE DRAWINGS

FIG. 1 a side view of the invention partially broken away as installed in a wooden structure which is resting on a poured concrete foundation.

DETAILED DESCRIPTION OF THE INVENTION

In general, as seen in FIG. 1, a low-flow, high-vacuum pump 34 is disposed within a housing chamber 32 for conducting radon-containing gas from beneath a floor slab 24 and for venting the gas to the atmosphere. The radon-containing gas is drawn under vacuum through a vacuum conduit 18 which provides fluid communication between a cavity 20 adjacent the floor slab 22 and housing chamber 32 for cooling a pump motor 38. Cool radon gas is pumped from vacuum conduit 18 and passes over pump motor 38 before entering the vacuum pump head 36 for venting to the atmosphere. High vacuum applied by vacuum pump 34 to cavity 20 extracts radon gas from soil beneath floor slab 24 without obstructing living quarters because piping of reduced diameter and of greater length than that required by fans is enabled by application of high vacuum. The housing chamber 32 contains cool radon gas drawn by vacuum pump 34 for cooling of pump motor 38. High vacuum reduces alterations which must be made to floor slab 24 to extract gas from earthen materials around and beneath the foundation to the vacuum conduit 18 since the vacuum suction alone is usually adequate t extract the radon from the soil of earthen material.

Noise and vibration are minimized by insulating the housing chamber 32 with a acoustical and thermal insulation, e.g., foam, fiberglass, etc. Insulation can also have incorporated therein lead shields to further reduce noise and to shield gamma radiation emanating from radon gas within the housing chamber and from radon which has plated out onto the interior surfaces of housing chamber 32 and over vacuum pump 34 and collected on these surfaces over extended periods of use. Noise is further reduced by cap 60. Vibration is further absorbed by straps 58.

Block 62 and water bypass 64 are disposed in vacuum conduit 18, which is shown in partial section in FIG. 1. Block 62 has perforate hole 68. Water bypass 64 is joined to perforate hole 68 to provide fluid communication between vacuum conduit 18 and vent 42. Condensation and water collected within vent 42 is discharged by force of gravity through block 62 and water bypass 64. Condensate is delivered through bypass 64 and vacuum conduit 18 to cavity 20. Block 62 baffles flow of air between vacuum conduit 18 and vent 42 to maintain-vacuum in housing chamber 32, vacuum conduit 18 and cavity 20. Delivery of condensate within the vacuum conduit prevents freezing of condensate and blockage of water bypass 64 which would otherwise occur if condensate were discharged out of doors.

In one embodiment of the invention, seen in FIG. 1, the vacuum system shown generally at 10 is shown installed in a building 12 and extending into floor slab 24. Housing 14 of system 10 is suspended over beams 16 of building 12 by straps 58 hanging from rafter 66. Fluid vacuum conduit 18 provides fluid communication between cavity 20 (located within and adjacent to floor slab 24) and housing chamber 32. Vacuum conduit 18 is sealed from the atmosphere at floor slab 24 and at inlet port 26 of housing 14. Vacuum conduit 18 can be disposed along floor beams 28 and within wall 30. It is to be understood that other configurations of the vacuum conduit 18 are possible, such as disposing the conduit within interior walls of building 12 or mounting the conduit exterior to walls. Housing chamber 32 is sealed from the atmosphere at chamber inlet port 26 and chamber outlet port 46. Vacuum pump 34 is disposed within housing 14. In this embodiment, a Gast Model regenerative blower is used, although it is to be understood other types of vacuum pumps may be used instead. Pump head 36 is driven by pump motor 38. Pumper inlet 40 of pump head 36 is in fluid communication with housing chamber 32. Vent 42 provides fluid communication between pump outlet 44 and the atmosphere.

The vacuum system 10 provides a method for conducting radon gas from beneath the floor slab 24 to the atmosphere. Vacuum pump 34 creates vacuum in housing chamber 32, vacuum conduit 18 and cavity 20. Vacuum in cavity 20 has an absolute pressure of greater than about 10" water. Naturally occuring radon and other gases within earthen excavation 48 is caused to flow by vacuum within cavity 20 toward vacuum conduit 18 at vacuum conduit entrance 15 positioned adjacent floor slab 24. Cool radon gas collected at conduit entrance 50 flows by vacuum through vacuum conduit 18 to housing 14. Cool radoncontaining gas enters housing chamber 32 at inlet port 26 and passes across pump motor 38, cooling pump motor 38. Heat generated by pump motor 38 is conducted to the radon-containing gas. Heat generated by pump motor 38 is thereby conducted or exhausted by radon-containing gas within housing chamber 32 to pump inlet 40. The radon-containing gas is then pumped by pump head 36 to the atmosphere through pump outlet 44 and vent 42. Pump motor 38 is thereby maintained at constant operating temperature within housing 14.

It is to be understood that vacuum conduit entrance 50 may be disposed in soil adjacent any part of foundation 22, such as at slab fitting joints 52 at foundation wall 54 or embedded at any point within earthen materials containing radon gas. Also, foundation 22 may be poured concrete, blocks constructed of cement or any building material disposed within an earthern excacation. Conduit entrance 50 may also be embedded in exposed soil, such as in a sump, not shown. Further, other embodiments of the present invention include but are not limited to disposing housing 14 within the foundation 22 or anywhere within structure 12 such as in a room, within a wall or within a closet. Housing 14 can also be disposed outside the structure, such as being mounted to wall 30, placed at grade level, or within a separate subterranean chamber, also not shown.

Equivalents

It is to be understood that gases other than those containing radon may also be removed from soil by the present invention. Other gases which can be extracted and vented to the atmosphere include naturally occurring gases or gases dissipating through soil from chemical discharge and leakage caused by manufacturing facilities and chemical storage and dumping. Examples of such gases include 1,1,1,dichloroethylene, trichloroethylene, paracholorethylene and other volatile chemicals including pesticides.

Although only preferred embodiments have been specifically described and illustrated herein, it will be appreciated that many modifications and variations of the present invention are possible, in light of the above teachings, within the purview of the following claims, without departing from the spirit and scope of the invention.

I claim:

1. A system for extracting gas emanating from soil at a subterranean cavity adjacent a floor slab and venting the gas to the atmosphere comprising:

a vacuum pump for pumping the gas to the atmosphere, having a pump motor, a pump inlet port and a pump outlet port;

a vacuum tight housing defining a housing chamber for housing the vacuum pump and having a housing outlet port and a housing inlet port and wherein the pump outlet port is coupled to the housing outlet port and the pump inlet port is coupled to the housing chamber;

a fluid vacuum conduit extending within said subterranean cavity for providing fluid communication between the cavity and the housing inlet port of the housing for coupling the gas to the housing to circulate gas over the motor;

a vent coupled to the housing outlet port for providing fluid communication between the pump outlet and the atmosphere.

2. The system of claim 1 wherein the gas includes radon gas.

3. The system of claim 1 wherein the includes volatile organic gases.

4. A system for extracting gas emanating from soil at a subterranean cavity adjacent a foundation structure and venting the gas to the atmosphere comprising:

a vacuum pump for pumping the gas to the atmosphere, having a pump motor, a pump inlet port and a pump outlet port;

a vacuum tight housing defining a housing chamber for housing the vacuum pump and having a housing outlet port and a housing inlet port and wherein the pump outlet port is coupled to the housing outlet port and the pump inlet port is coupled to the housing chamber;

a fluid vacuum conduit extending within said subterranean cavity for providing fluid communication between the cavity and the housing inlet port of the housing for coupling the gas to the housing to circulate gas over the motor;

a vent coupled to the housing outlet port for providing fluid communication between the pump outlet and the atmosphere; and a water bypass conduit coupled between the housing inlet port and housing outlet port which provides fluid communication between the vent and the vacuum conduit for returning moisture in the gas to the subterranean cavity.

5. A system for extracting radon gas from subterranean cavity adjacent a foundation structure and venting the gas to the atmosphere comprising:

a vacuum pump for pumping the radon gas to the atmosphere, having a pump motor, pump inlet port and a pump outlet port;

a vacuum tight housing defining a housing chamber for housing the vacuum pump and having a housing outlet port and a housing inlet port and wherein the pump outlet port is coupled to the housing outlet port and the pump inlet port is coupled to the housing chamber;

a fluid vacuum conduit extending within said subterranean cavity for providing fluid communication between the cavity and the housing inlet port of the housing for coupling the radon gas to the housing to circulate the gas over the motor;

a vent coupled to the housing outlet port for providing fluid communication between the pump outlet and the atmosphere; and a water bypass conduit coupled between the housing inlet port and housing outlet port which provides fluid communication between the vent and the vacuum conduit for returning moisture in the gas to the subterranean cavity.

6. The system of claim 1 wherein the housing chamber is sealed from the atmosphere at the inlet port and at the outlet port of the housing chamber.

7. A system of claim 5 further including insulation for insulating the housing chamber.

8. A system of claim 5 wherein the insulation includes lead for shielding gamma rays emanating from the radon-containing gas and radon spraying.

9. A system of claim 5 further including a water bypass which provides fluid communication between the vent and the vacuum conduit for delivery of condensate from the vent to the vacuum conduit and to the cavity.

10. A system for extracting gas emanating from soil at a subterranean cavity adjacent a foundation structure and venting the gas to the atmosphere comprising:

a vacuum pump for pumping the gas to the atmosphere, having a pump inlet and a pump outlet;

a housing chamber housing the vacuum pump and having an inlet port and an outlet port coupled to the housing chamber;

a fluid vacuum conduit extending within said subterranean cavity for providing fluid communication between the cavity and the inlet port of the housing chamber for coupling the gas to the interior of the housing to cool the pump;

a vent disposed at the outlet port for providing fluid communication between the pump outlet and the atmosphere; and a water bypass which provides fluid communication between the vent and the vacuum conduit for delivery of condensate.

11. A method for extracting gas emitting from soil at a subterranean cavity adjacent a floor slab and venting to the atmosphere comprising the steps of:

disposing a vacuum pump and vacuum pump motor within a housing chamber;

pumping cool gas from the cavity to the housing chamber;

directing the radon-containing gas within the housing chamber across the vacuum pump motor thereby cooling the vacuum pump motor; and venting the radon-containing gas to the atmosphere.

12. A method for extracting radon gas from a subterranean cavity adjacent a foundation structure and venting to the atmosphere comprising the steps of:

disposing a vacuum pump and vacuum pump motor within a housing chamber;

pumping cool radon-containing gas from the cavity to the housing chamber;

directing the radon-containing gas within the housing chamber across the vacuum pump motor thereby cooling the vacuum pump motor; and venting the radon-containing gas to the atmosphere.

13. The method of claim 11 wherein the gases include radon gas.

14. A method for cooling a vacuum pump motor extracting radon-containing gas from a subterranean cavity adjacent a foundation structure and venting to the atmosphere comprising steps of:

disposing a vacuum pump and vacuum pump motor within a housing chamber;

forming a fluid vacuum conduit providing fluid communication between the cavity and the housing chamber;

forming a vent providing fluid communication between the vacuum pump and the atmosphere;

pumping cool radon-containing gas from the cavity through the fluid vacuum conduit to the housing chamber;

directing the cool radon-containing gas within the housing chamber across the vacuum pump thereby cooling the vacuum pump motor;

venting the radon-containing gas from the vacuum pump through the vent to the atmosphere.

15. A system of claim 4 wherein the housing outlet port is elevated above the housing inlet port, whereby condensate is directed through the water bypass conduit from the vent to the vacuum conduit by gravity.

16. A system of claim 4 further comprising a constriction for baffling flow of air between the vacuum conduit and the vent sufficient to maintain vacuum in the housing chamber, the vacuum conduit and the cavity.

17. A system of claim 16 wherein the constriction comprises a block disposed in the vacuum conduit defining a perforate hole to which the water bypass conduit is joined.

* * * * *